United States Patent [19]

Sams

[11] 3,972,281

[45] Aug. 3, 1976

[54] ADJUSTABLE PRINT-OUT SELECTION MECHANISMS

[75] Inventor: Bernard Sams, London, England

[73] Assignee: Norprint Limited, England

[22] Filed: July 18, 1974

[21] Appl. No.: 489,611

Related U.S. Application Data

[63] Continuation of Ser. No. 295,354, Oct. 5, 1972, abandoned.

[30] Foreign Application Priority Data

Oct. 7, 1971 United Kingdom ..... 46576/71

[52] U.S. Cl. ..... 101/110; 197/182; 101/111

[51] Int. Cl.[2] ..... B41J 1/32

[58] Field of Search ..... 101/14, 45, 59, 75, 101/79, 85–88, 95, 99, 110, 111, 93.22; 197/189

[56] References Cited

UNITED STATES PATENTS

| | | | |
|---|---|---|---|
| 276,986 | 5/1883 | Hare | 101/85 |
| 427,688 | 5/1890 | Hooper | 197/182 |
| 631,114 | 8/1899 | Hulse | 197/182 |
| 766,635 | 8/1904 | Luitwieler | 101/110 |
| 1,090,626 | 3/1914 | Kelley | 101/110 X |
| 1,738,373 | 12/1929 | Eiedtke | 101/110 X |
| 1,968,347 | 7/1934 | Oshsenbein | 101/110 X |
| 2,136,461 | 11/1938 | Petty | 101/110 X |
| 2,157,497 | 5/1939 | Petty | 101/110 X |
| 2,686,468 | 8/1954 | Bliss | 101/99 X |
| 3,307,676 | 3/1967 | Hickerson | 101/110 X |
| 3,572,239 | 3/1971 | Grenier | 101/99 X |
| 3,589,281 | 6/1971 | Woodhead | 101/110 |
| 3,669,016 | 6/1972 | Kittel | 101/110 |
| 3,720,298 | 3/1973 | Alonas | 197/182 |

FOREIGN PATENTS OR APPLICATIONS

| | | | |
|---|---|---|---|
| 248,231 | 4/1963 | Australia | 101/79 |
| 1,101,730 | 10/1955 | France | 101/110 |
| 525,192 | 1/1929 | Germany | 101/79 |
| 183,165 | 4/1963 | Sweden | 101/110 |
| 610,181 | 10/1948 | United Kingdom | 101/110 |

*Primary Examiner*—Edgar S. Burr
*Assistant Examiner*—Edward M. Coven
*Attorney, Agent, or Firm*—McGlew and Tuttle

[57] ABSTRACT

An adjustable facet print mechanism includes a plurality of print wheels in one embodiment each meshing constantly on an internal periphery with a pinion. Annular members are also provided and each meshes with a corresponding pinion of one of the print wheels and each carries read-out indicia corresponding to the print-facets of the print wheels. Drive to the print wheels to adjust their operative facets is effected through a splined shaft which engages a selected annular member when a notch in a cam engages the periphery of the annular member. A read-out arrangement includes an arm of transparent material with a prismatic face lying opposite the indicia selected.

Other embodiments make use of slightly flexible print wheels to effect engagement with a splined shaft and one embodiment uses print bands in place of wheels. In the latter embodiment selection of a print band for adjustment is effected by an interrupted pinion carried on fingers integral with an adjusting knob. These fingers interdigitate with further fingers and relative axial sliding movement enables the interrupted pinion to engage selectively one of a plurality of annular members around which the respective print bands are trained.

14 Claims, 15 Drawing Figures

ADJUSTABLE PRINT-OUT SELECTION MECHANISMS

This is a continuation of application Ser. No. 295,354 filed Oct. 5, 1972.

BACKGROUND OF THE INVENTION

1. Field of the Invention

This invention relates to adjustable-facet print mechanisms, for example for use in hand-held self-adhesive-label applicators where space requirements are very stringent, but it is nevertheless necessary to provide for a wide range of print facets giving, at any given time, a print-out facility for a number of characters in the range one to forty or even more.

2. Description of the Prior Art.

Adjustable facet print mechanisms have been proposed in which individual print-facet carriers are adjustable by individual knobs. Where there is a large number of carriers the corresponding number of knobs gives rise to a cumbersome mechanism. Again it is not always possible with prior mechanisms to appreciate readily the print-out at any given adjustment of the individual carriers and one object of the present invention is to provide a read-out facility.

SUMMARY OF THE INVENTION

According to the present invention there is provided in an adjustable-facet print mechanism a plurality of endless print-facet carriers arranged side-by-side and movable independently of one another around a common axis to adjust the print-facets operative at any given setting, adjusting means accessible for actuation laterally of an outermost one of said print-facet carriers for adjusting at any given setting a selected one of the carriers to provide an alternative operative print-facet of that carrier, said adjusting means being arranged to engage the carrier internally and being common to all said carriers, selecting means for coupling the adjusting means to a selected said print-facet carrier, said selecting means being accessible for actuation at a position at least aligned with the actuation position of the adjusting means, and prismatic read-out means for displaying visually and positively the characters of those print-facets of the carriers which are operative at any given setting in an array which corresponds substantially with that of the print-facets themselves.

BRIEF DESCRIPTION OF THE DRAWINGS

Certain embodiments of adjustable-facet print mechanisms in accordance with the present invention will now be described by way of example, with reference to the accompanying diagrammatic drawings, in which.

DESCRIPTION OF THE PREFERRED EMBODIMENTS

Figure 1:
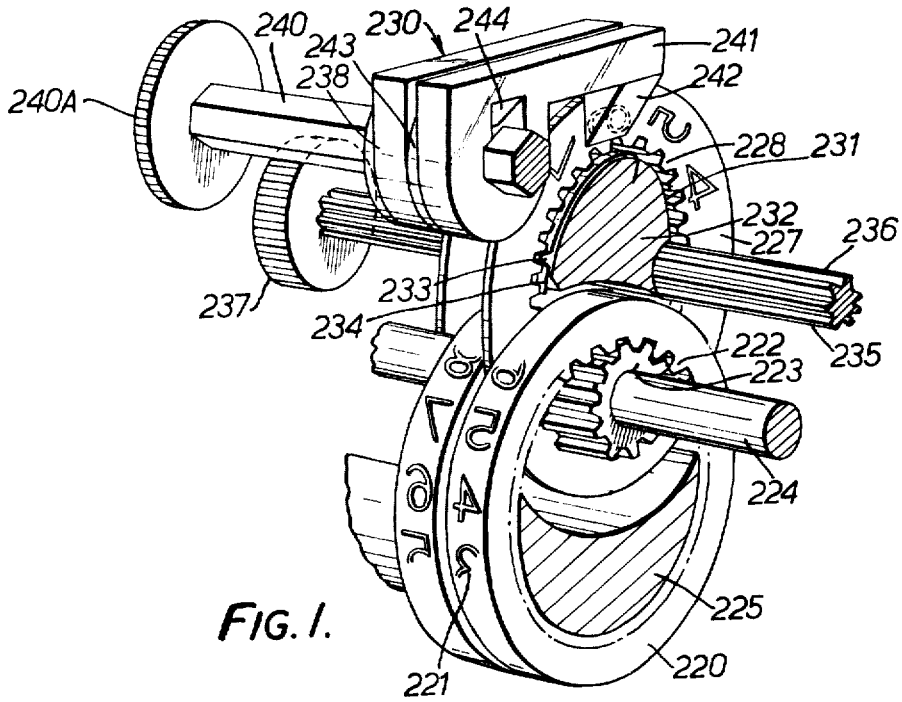
FIG. 1 is a perspective view of a first embodiment.
Figure 2:
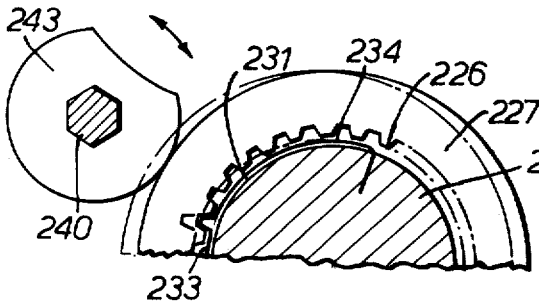
FIG. 2 is a section of a part of the mechanism of FIG. 1.
Figure 3:
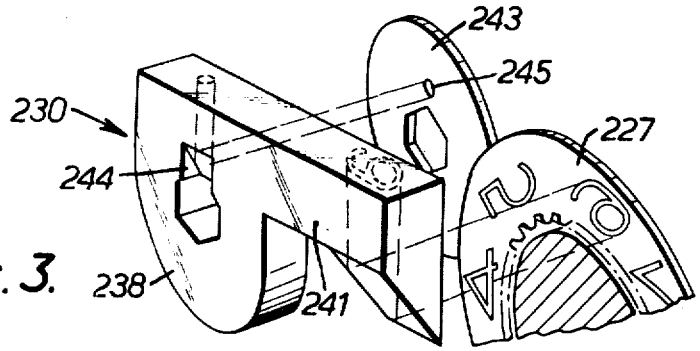
FIG. 3 is a perspective exploded view of an optical read-out device of the mechanism of FIGS. 1 and 2.

Referring now to the drawings, the first embodiment illustrated in FIGS. 1 to 3 of an adjustable-facet print mechanism in accordance with the invention is intended for incorporation in a self-adhesive label applicator, for example as disclosed in my copending application Ser. No. 283,212, filed Aug. 23, 1972, and now U.S. Pat. No. 3,890,188, issued June 17, 1975. It includes a plurality, for example six, of print-out wheels 220 (only two shown) each of which has a plurality of facets each providing for the printing of a discrete character 221. Each wheel 220 is effectively in the form of an annulus and has on its internal periphery a row of coarse gear-like teeth 222 which mesh constantly with a pinion 223 mounted on a shaft 224 extending transversely of the housing of a label applicator or other printing machine as a whole (not shown). The tips of the teeth 222 are also in sliding contact with a part-cylindrical surface of a crescent-section member 225 which extends across interior of and is secured at its ends in the housing. The member 225 provides for constraint of the wheels 220 in the radial sense, while axial constraint is provided by the housing of the machine, the close spacing of the wheels themselves and packing pieces as necessary.

The pinion 223 also meshes constantly with a row of internal gear-like teeth 226 of a relatively thin read-out wheel 227 co-operates with an optical device to provide a read-out facility so that an operator can at once know the actual operative facet of the associated gear wheel 220. The facets of the wheels 220 and 227 are, of course, synchronized so that the print facet will be in exact correspondence with the facet of the wheel 227 which is read by an optical device 230 to be described in greater detail hereinafter. Each wheel 227 corresponds with one of the print wheels 220 and is guided by a transverse member 232 having a part-cylindrical surface 231 juxtaposed to the tips of the teeth 228 of the wheel 227. The member 232 carries spaced along its length a plurality of springs 234 one end of each of which is anchored in the member and the other end of which has at least one projection 233 engaged in one of the spaces between the teeth 228 of a respective wheel 227. This spring 234 prevents inadvertent turning of the wheel 227, and hence also of the wheel 220, and also serves to bias the wheel 227 to the chain line position of FIG. 2. The teeth 228 are also arranged to mesh with a shaft 235 having a plurality of continuous teeth or splines 236. At one end of this shaft there is a control knob 237 which serves to rotate a selected one of the wheels 227. The selection mechanism will be described hereinafter. In an unillustrated modification, the springs 234 are replaced by a single comb spring mounted in the housing.

The optical device 230 includes a transparent plastics member having a boss 238 centred on a hexagonal shaft 240 and an arm 241 having a depending tongue 242 one face of which lies in opposed relationship to a character on the wheel 227 which corresponds, at any given time, to the character which will be printed by the wheel 220. A generally circular washer 243 is mounted on the shaft 240 and in contact with the boss 238. The washer has a concave notch or recess with a curvature complementary to that of the wheel 227 and when it comes into contact with the periphery of the wheel 227, as the shaft 240 is turned by a knob 240A, the latter rises under the bias of the spring 234 and thus the internal teeth 226 of the selected wheel 227 come into engagement with the splines 236. The knob 237 is then turned until the fresh facet is reached. The optical device 230 also includes an angled facet 244 disposed adjacent to the aperture which receives the shaft 240 and opposite a spot 245 provided on one side face of the washer 243 when the concave notch of that washer is engaged with the periphery of the corresponding wheel 227.

It will be appreciated that for each wheel 220 there is a corresponding wheel 227, an optical device 230 and a washer 243. The washers 243 are each differently orientated on the hexagonal shaft 240 and the number of sides of the shaft will in modified constructions correspond at least to the number of print wheels. The sides need not be flat and it is only necessary that the cams can be arranged in a number of orientations corresponding at least to the number of print wheels.

To select a fresh facet 221 on a particular wheel 227, the knob 240A is turned until the spot 245 is visible in the top face of the arm 241. The splines 236 of the shaft 235 then mesh with the teeth 226 and rotation of the knob 237 will then cause rotation of the wheel 227, the pinion 223 and the print wheel 220. The operator will cease to rotate the knob 237, when the required character appears at the upper surface of the arm 241.

Figure 4:
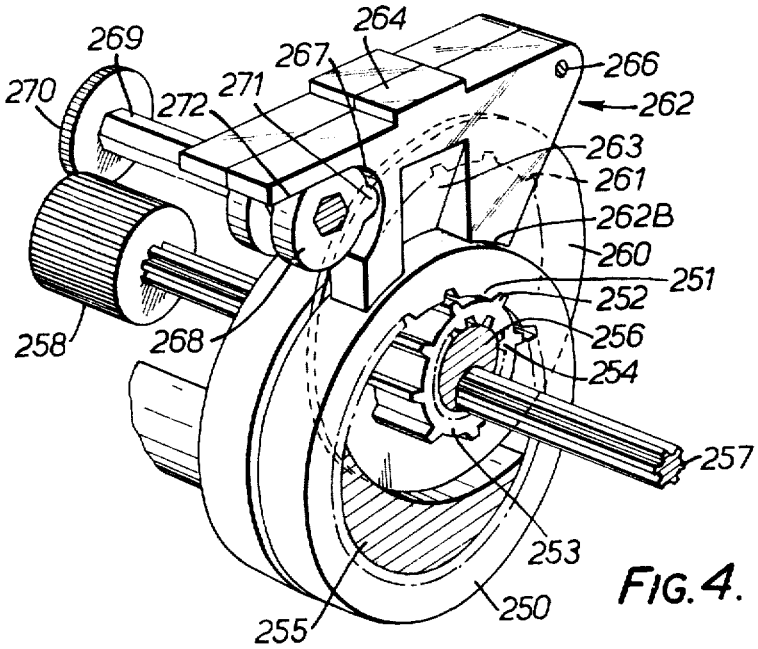
FIG. 4 is a perspective view of a second embodiment.
Figure 5:
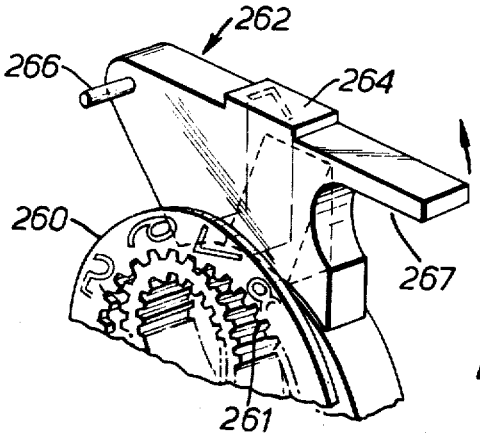
FIG. 5 is a fragmentary perspective view of a part of the mechanism of FIG. 4.

Referring now to FIGS. 4 and 5, in this embodiment each print wheel 250 is made of a hard rubber or other material which has a limited degree of flexibility. Each wheel 250 has a plurality of facets and an internal annulus of coarse gear-like teeth 251 which mesh with external teeth 252 of a pinion which also has internal teeth 254. The lower half (as illustrated) of each print wheel 250 is in sliding contact with a part-cylindrical surface of a crescent section member 255 which extends transversely of and is secured to the housing (not shown) of a label applicator or other machine. The pinion 253 is mounted on a generally cylindrical guide member 256 carried at its ends in the machine housing and the pinion is also arranged to mesh with a transverse shaft 257 having ridges or splines extending along its length and carrying an adjusting knob 258 at one end thereof. The shaft 257 is accommodated in a cylindrical recess in the member 256 and is normally disengaged from the internal teeth of the pinion 253.

In this embodiment the optical read-out mechanism is combined with a mechanism for activating the drive from the splined shaft 257 to a selected one of the resilient print wheels 250. As in the first embodiment each print wheel 250 is associated with a thin washer-like member 260 having internal teeth 261 and has characters corresponding and synchronized with those of the associated print wheel provided on one face thereof. A transparent plastics member 262 has an angled facet 263 which is arranged to transmit an image of a selected one of the characters on the disc-like member 260 and display it on a raised facet 264 provided on an upper surface of the member 262. Each member 262 is pivotable about a spindle 266 and, at the opposite end thereof, has a part-cylindrical recess 267 which accommodates cams 268 (only two shown) fast for rotation with a hexagonal-section shaft 269 extending across the width of the machine and rotatably mounted in the housing thereof. Each member 262 has part-cylindrical surfaces 262A and 262B which are juxtaposed to or are in sliding contact with the peripheral surface of the wheel 250.

An adjustment knob 270 is secured to one end of the hexagonal shaft 269. Each cam 268 has a nose 271 which, when it engages a flat part 272 of the recess 267 of the corresponding member, raises the member 262 and thus causes engagement of the splined shaft 257 with the internal teeth of the pinion 253. The pivotal movement of the member 262 as a result of engagement of the nose 271 of the cam 268 causes distortion of the wheel 250 so that the pinion 253 is pressed into and held in mesh with the splined shaft 257. The latter is then rotated by the knob 258 and when the selected character appears at the facet 264, the required selection is completed. Because of the presence of the member 255 the part of the wheel 250 in active use for printing is not substantially distorted. It will be apparent that each cam 268 on the shaft 269 is differently orientated with respect to the remaining cams.

Operation requires rotation of the knob 270 until the selected member 262 is raised. The knob 258 is then turned until the selected character appears at the facet 264.

Figure 6:
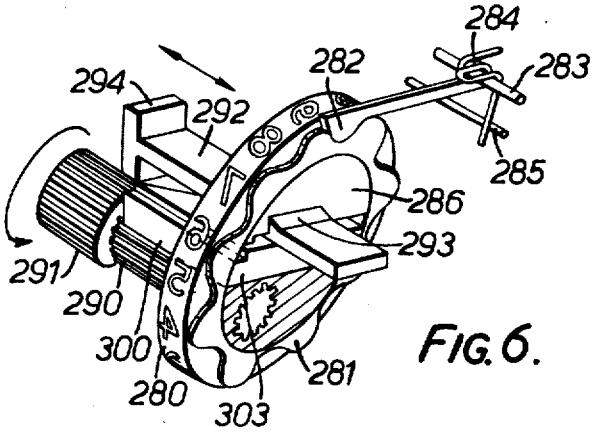
FIG. 6 is a fragmentary perspective view of a third embodiment.
Figure 7:
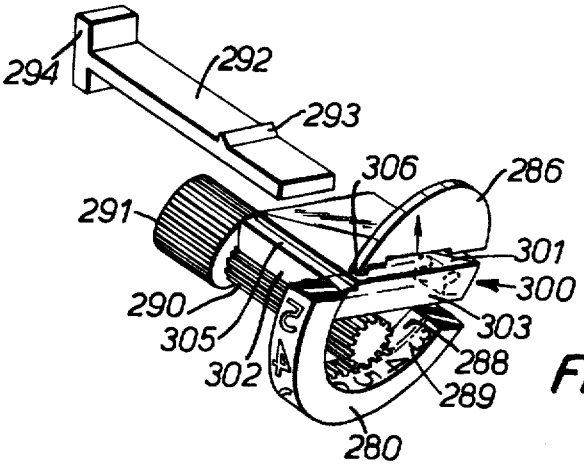
FIG. 7 is a fragmentary perspective view of the embodiment of FIG. 6 with certain parts thereof cut-away in order further to explain the operation of the embodiment.

Referring now to the embodiment of FIGS. 6 and 7, a print wheel 280, being one of a plurality of similar print wheels of generally annular form, has an integral notched end-profile 281 which is engaged by a spring-loaded pawl 282 pivotable about a rod 283 and spring-loaded by a spring 284, one end of which abuts against a rod 285. Both the rods 283 and 285 are mounted at each end in the housing or casing of a label applicator or other machine and are common to the pawls 282 of all the print wheels. The internal periphery of the wheel 280 is supported on a member 286 of generally segmental shape and the cylindrical surface of which engages the internal periphery of the print wheel. The inner periphery of the print wheel is provided with an annulus of gear teeth 288 and with representations 289 of the negative characters on the facets of the external periphery of the wheel. The positive characters 289 are read for read-out purposes by an optical device to be described hereinafter.

Once a particular print wheel has been selected for change of facet the internal teeth 288 are engaged in mesh with a splined shaft 290 rotatably mounted in the housing of the machine and having a knob 291 accessible externally of the housing or casing.

A particular print wheel 280 is selected for change of facet by a rectangular plate member 292 having a transverse ridge 293 and a finger grip 294 at one end which projects outside the machine housing. The ridge is suitably inclined to provide smooth operation and therefore acts in the manner of a cam. The transverse ridge 293 is arranged to engage selectively with a lower surface of one of the members 286 and such engagement effectively raises the print wheel selected and brings the splined shaft 290 into engagement with the internal teeth 288 of the selected wheel. Once selected, rotation of the knob 291 effects rotation of the corresponding wheel 280 until the selected character appears through an optical device 300 now to be described.

The optical device 300 takes the form of a transparent plastics prism 301, one face 302 of which is juxtaposed to the internal annulus of the positive characters 289 and another, read-out, face 303 of which is visible through a slot (not shown) of the housing. It will be apparent that images of the positive characters 289 are transmitted by the prism 301 as a result of total internal reflection and it will also be clear that a common prism provides indications of the read-out on each print wheel at any given time. The upper edge of the prism 301 in part defining the surface 302 has a longitudinal groove 305 engageable by a pip 306 on the member 286 when the shaft 290 is no longer in engagement with the teeth 288.

The manner of operation of the mechanism is briefly as follows. When it is desired to change the operative facet of one of the print wheels 280, the member 292 is slid to a position such that the ridge 293 engages the undersurface of the selected member 286 and the pip 306 thereof then lifts out of the groove 305 adjacent the surface 302 of the prism 301. The image of the pip at the read-out face 303 of the prism disappears to indicate that the drive is engaged. This engagement by the ridge causes meshing of the shaft 290 with the teeth 288 and the knob 291 is then rotated until the desired read-out character is displayed on the face 303. The spring-loaded pawl 282 and the notched end-profile 281 prevent inadvertent movement of the wheel 280 and also ensure that the character selected is correctly registered.

Figure 8:
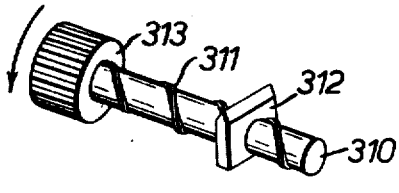
FIG. 8 is a perspective view of an alternative form of a part of the mechanism of FIG. 6.

In a modification of the embodiment of FIGS. 6 and 7, as illustrated in FIG. 8 the flat member 292 is replaced by a shaft 310 with a coarse pitch thread 311 which serves to move a nut 312 serving a similar purpose and having a similar form to the ridge 293. The shaft 310 is rigid with a knob 313. In this modification the selection is made by rotation instead of the linear motion of the member 292.

Figure 15:
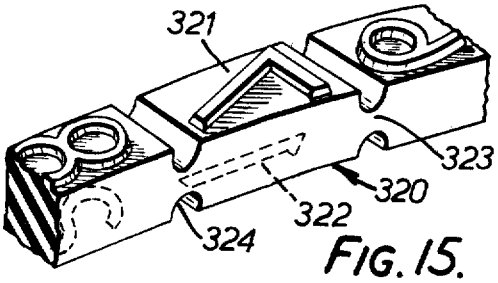
FIG. 15 is a perspective view of a portion of a print band as incorporated in the fourth and fifth embodiments.

In the embodiments of FIGS. 9 to 14, print bands 320 are used as illustrated in FIG. 15. Each such band includes a multiplicity of facets 321 each carrying a character on one face to provide a print-out while the obverse side 322 provides a positive image to provide a read-out to an optical device. It will be noted that the individual facets, as clearly shown in FIG. 15, are joined together by flexible sections 323 defined by one or more concave grooves 324 leaving a thickness of material at the flexible sections which may be less than half that of the facets 321 themselves.

Figure 9:
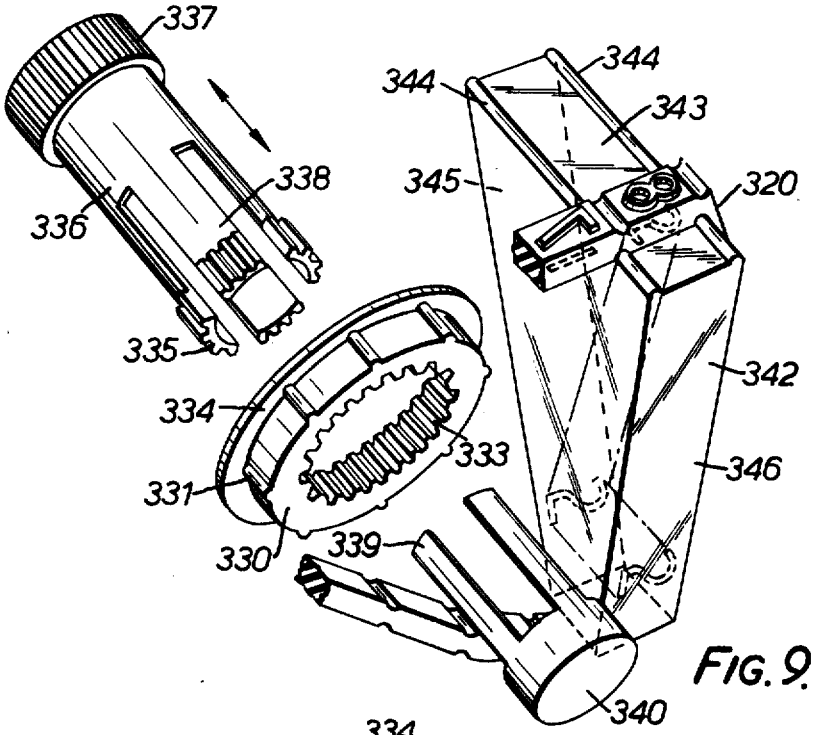
FIG. 9 is an exploded perspective view of a fourth embodiment.
Figure 10:
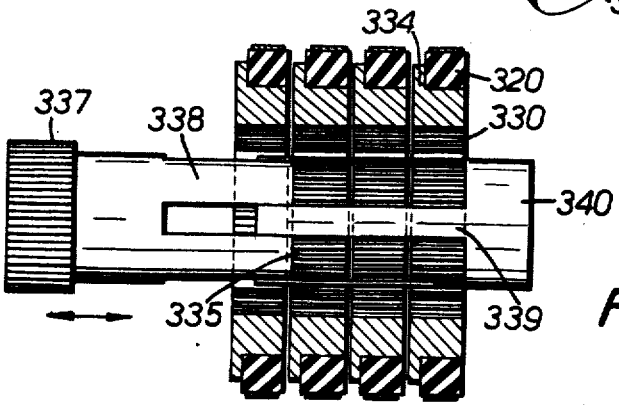
FIG. 10 is a longitudinal section of a part of the fourth embodiment.
Figure 11:
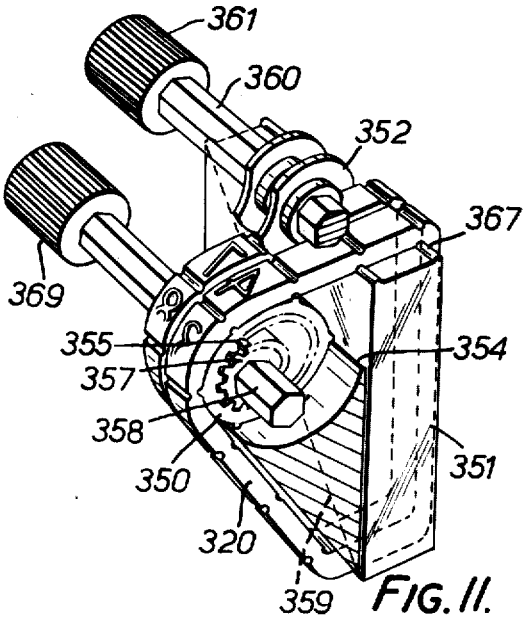
FIG. 11 is a perspective view of a fifth embodiment.
Figure 12:
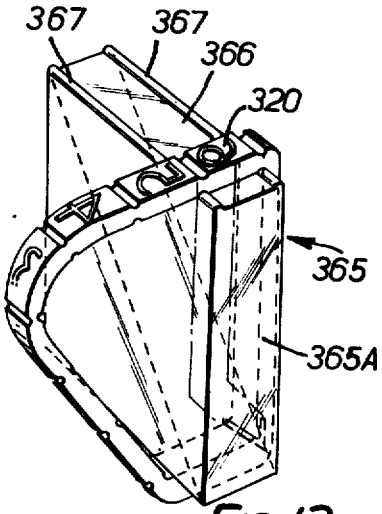
FIG. 12 is a perspective view of an optical device forming a part of the fifth embodiment.
Figure 13:
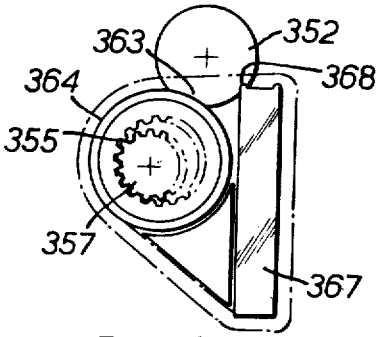
FIG. 13 is a side elevation of the fifth embodiment in one operational configuration.
Figure 14:
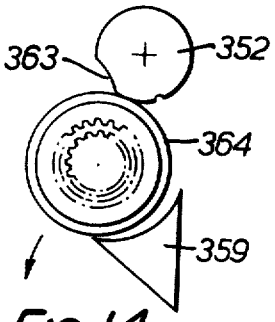
FIG. 14 is a side elevation similar to FIG. 13, but in another operational configuration.

Referring now particularly to FIGS. 9 and 10 in which only one print band is illustrated for the sake of clarity, a drive pinion 330 has a plurality of equally spaced ridges 331 of complementary form to the concave faces of the joining sections of the band when they have a configuration corresponding to the bend of the band where it passes over the drive pinion. The drive pinion has, in addition to the external ridges 331, a set of internal gear-like teeth 333 and also an end flange 334 which provides guidance for the band 320 under consideration and also one adjacent band.

It will be apparent that there will be a plurality of print bands corresponding to the desired number of digits to be produced at each print-out operation, and adjustment of a particular print band to render another facet operative is effected by means of a plurality of gear teeth disposed in an interrupted annulus 335 and mounted on a hollow pluglike member 336 rotatable in the housing of the machine and having an external adjusting knob 337. The interrupted annulus 335 carrying the gear teeth lies at the end of a corresponding plurality of fingers 338 of this member 336 and these fingers interdigitate with complementary fingers 339 of a member 340 rotatable in the opposite side wall of the casing or housing. The interdigitating fingers 338, 339 enable the interrupted annulus 335 to be slid axially to engage a selected one of the drive wheels 330 and these fingers also serve as bearings for each of the drive wheels.

In order to provide a read-out for the selected characters on each band 320, a prism 342 is provided which has, as shown, an upper face 343 with ridges 344 along each edge of a form complementary to the concave faces of the band 320 as taken up in the position as shown. As hereinbefore mentioned, the obverse face of the band has positive characters which are reflected by a face 345 of the prism 342 which is inclined to the face 343 and an image of the character is produced as indicated at the face 346 of the prism.

The manner of operation of this embodiment is extremely simple and it is merely necessary to displace the member 336 axially with respect to the member 340 and, when the appropriate drive wheel 330 has been engaged by the interrupted annulus 335 to rotate the knob 337 and thereby rotate the band 320 until the desired character appears on the face 346.

In the embodiment of FIGS. 11 to 14 each print band 320 is movable around a pinion 350 and a prism 351 and some guidance is provided by a cam 352 which forms part of a print band selection mechanism. The pinion 350 has a plurality of ridges 354 spaced around the periphery thereof and arranged to engage the concave faces 324 of the joint sections 323 in the band. The pinion 350 also has an internal set of gear-like teeth 355 which mesh, under the conditions illustrated in FIG. 13, with a pinion 357 fast for rotation with a hexagonal shaft 358. Additional guidance and support for the bands is provided by a member 359 which extends between and is supported in the sides of the machine housing.

In order to select a particular print band for adjustment, a hexagonal shaft 360 carrying the cams 352 is rotated by means of a knob 361 fast therewith until the selected cam 352 engages with a concave notch 363, on the periphery of a plain portion 364 of the pinion 350. As is apparent from FIG. 13, the pinion 350, when the notch engages the portion 364, rises so that the pinion 357 meshes with the internal gear teeth 354 of the pinion 350 and hence rotation of the shaft 358 can be effected by means of a knob 369 which indexes the print band to the required new position.

The optical device of this embodiment takes the form of a prism 365 of which the upper surface 366 has a pair of ridges 367 along each longer edge, the spacing of which corresponds to the spacing between each of two adjacent concave faces 324 of the band 320. An image of a positive character on the obverse face of the band is totally internally reflected to a lateral face 365A of the prism as is apparent particularly from FIG.

12. The cam 352 has a notch 368 spaced from the notch 363 and this is arranged to engage one of the ridges 367 of the prism when the cam has reached its selected position.

Briefly the manner of operation of this embodiment is that the knob 361 is rotated until the cam 152 corresponding to the selected print band engages, with its concave notch 363, on the wheel 364 fast with the pinion 350 thus allowing the pinion to rise and the pinion 357 to engage with the internal teeth of the pinion 350. Rotation of the knob 369 will in turn cause rotation of the band 320 which has been selected until the desired character appears on the face 365A of the prism 365.

In any of the preceding embodiments, the number of print wheels or bands can be varied as desired provided that appropriate numbers of selection mechanisms are also provided. The parts of the label applicator or other machine not illustrated may be conventional.

I claim:

1. In an adjustable-facet print mechanism a plurality of endless print-facet carriers arranged side-by-side and movable independently of one another around a common axis to adjust the print-facets operative at any given setting, each said carrier comprising a print wheel of annular form having an internal annulus of teeth, adjusting means accessible for actuation laterally of an outermost one of said print-facet carriers for adjusting at any given setting a selected one of the carriers to provide an alternative operative print-facet of that carrier, said adjusting means being arranged to engage the carriers internally and being common to all said carriers, and comprising a splined shaft engageable selectively with the annulus of teeth of each print wheel, selecting means for coupling the adjusting means to a selected said print-facet carrier, said selecting means accessible for actuation at a position at least substantially aligned with the actuation position of the adjusting means, and comprising a plurality of part-circular members, one being disposed within each print wheel and a member movable within the print wheels along a path parallel to the common axis of the wheels and so disposed that when lying within a selected wheel the part-circular member thereof shifts the selected wheel so that the internal annulus of teeth thereof meshes with the splined shaft whereby the wheel can be adjusted to a fresh operative facet by rotation of the shaft, prismatic read-out means for displaying visually and positively the characters of those print-facets of the carriers which are operative at any given setting in an array which corresponds substantially with that of the print-facets themselves.

2. A mechanism according to claim 1, wherein the readout means comprises a set of characters on the inside surface of each print wheel corresponding to the print-facets and a prism extending through the print wheels and having one face juxtoposed to one of the set of characters of each wheel.

3. In an adjustable-facet print mechanism, a plurality of endless print-facet carriers arranged side-by-side and movable, independently of one another, around a common axis to adjust the print-facets operative to produce a print impression; respective hollow driving means operatively associated with each carrier and normally ineffective to adjust the associated carrier; adjusting means, accessible for actuation at an actuation position laterally of an outermost one of said print-facet carriers operable, when actuated, to adjust the driving means of a selected one of said carriers to adjust the associated carrier to provide an alternative operative print-facet of the selected carrier; said adjusting means continuously extending through all of said driving means; selecting means operable to couple a selected driving means to said adjusting means to render the selected driving means effective to adjust its associated print-facet carrier, said selecting means being accessible for actuation at a position at least substantially aligned with the actuation position of said adjusting means; respective detenting means for retraining each print-facet carrier against movement except when its associated driving means is effective to rotate the print-facet carrier; and means for guiding the movement of the print-facet carriers during adjusting movement thereof, said guiding means including prismatic read-out means for displaying visually and positively the characters of those print-facets of the carriers which are then operative, in an array corresponding substantially with that of the print-facets themselves.

4. A mechanism according to claim 3 wherein each said carrier comprises a print band and each band includes a plurality of print-facets, each facet being divided from the adjacent facets by grooves extending inwardly from both faces of the band, said adjustment means comprises for each band a wheel having projections engaging constantly in the grooves of the band and an internal annulus of teeth, and said selecting means comprises a pinion for each band engageable with the internal annulus of teeth and a respective cam mounted adjacent each band and selectively rotatable to a selected angular position to interengage the corresponding pinion with the associated annulus of teeth, whereby rotation of the pinion serves to adjust the corresponding print band.

5. A mechanism according to claim 4 wherein the readout means comprises characters obverse to the print-facets of each band and a single prism extending within the print bands and serving at one edge to support the print bands so that an obverse character at that edge is optically transmitted to an accessible face of the prism to provide an optical display.

6. A mechanism according to claim 5, wherein said edge of the prism has a pair of ridges which serve to engage adjacent grooves of the print bands thereby accurately to locate the bands, an opposite edge of the prism serving as a support for the operative print-facets.

7. A mechanism according to claim 3, wherein said carriers each comprise a print band having internal grooves, and said selection means includes a wheel for each print band having projections engaging constantly in grooves of the print band, and an internal annulus of teeth, a control knob, an interrupted pinion secured to rotate with the knob, first fingers rigid with the control knob and each carrying a portion of the interrupted pinion, second, rotatable, fingers in interdigitating relationship with the first fingers, said control knob and the interrupted pinion being axially movable relatively to the second fingers whereby the interrupted pinion can engage the internal annulus of a selected one of said wheels and thereby move the corresponding print band.

8. A mechanism according to claim 3, wherein each said print-facet carrier comprises a print wheel of annular form and having an internal toothed annulus, said adjustment means comprises for each print wheel a pinion in constant mesh with the internal toothed annulus, and said selecting means and read-out means comprises a plurality of read-out wheels of annular form interdigitated with the print wheels, having an internal toothed annulus and in constant mesh with a corresponding said pinion, a splined shaft engageable with a selected one of the annulii of the read-out wheels, means biasing the splined shaft out of engagement with the internal toothed annulii of the readout wheels and, means for selectively overcoming the bias of said biasing means whereby to engage drivingly the shaft and the selected read-out wheel and provide a drive between the read-out wheel and the selected print wheel to adjust the print wheel to the required character.

9. A mechanism according to claim 8, wherein said means for selectively overcoming the bias of the biasing means comprises a plurality of washer-like members corresponding in number to the number of print wheels and each having a notch in its periphery which on engagement with the periphery of the corresponding read-out wheel allows the latter to move under the influence of the biasing means to engage the splined shaft, each washer-like member being angularly orientated differently to the other washer-like members.

10. A mechanism according to claim 9 wherein the means for selectively overcoming the bias of the biasing means further comprises a shaft having in cross-section a number of sides corresponding to the number of print wheels, said washer-like members being mounted on the shaft in mutually different angular orientations.

11. A mechanism according to claim 10, wherein the read-out means further comprises a plurality of arms of transparent material each arm carrying a tongue, the arms corresponding in number to the number of print wheels and being loosely mounted on the said shaft and each so orientated that the tongue thereof lies in opposed relationship to the corresponding characters of the read-out wheels, said tongue having a prism form such that the character for the time being lying opposite is displayed at an accessible face of the arm.

12. A mechanism according to claim 11, wherein each washer-like member carries an indicator mark thereon arranged to provide a visual indication on said face of the corresponding arm when that washer-like member has the notch thereof engaged on the periphery of the corresponding read-out wheel.

13. A mechanism according to claim 3, wherein each said print-facet carrier comprises a print wheel of limited flexibility and annular form and having an internal annulus of teeth, a pinion forming part of the adjusting means in constant mesh with said internal annulus of teeth and itself having an internal annulus of teeth, wherein the adjusting means further comprises a splined shaft engageable with the annulus teeth of the pinion, and wherein the selecting means comprises a plurality of pivotal arms each in close proximity to a corresponding one of the print wheels, and a cam member for each arm effective when a nose thereof is in a predetermined orientation to pivot the arm and thereby to distort the print wheel to cause the pinion thereof to mesh with said splined shaft.

14. A mechanism according to claim 13, wherein the pivotal arms are of transparent material and the read-out means of the mechanism further comprises a number of read-out wheels corresponding in number to and interdigitated between the print wheels, said arms being transparent and having prismatic faces which serve to display at an accessible face thereof the operative print-facet of the corresponding print wheel.

* * * * *